US005553552A

United States Patent [19]

Bauer et al.

[11] Patent Number: 5,553,552

[45] Date of Patent: Sep. 10, 1996

[54] ELECTRONIC STORAGE CABINET AND LIGHTED SIGN ASSEMBLY FOR AN AUTOMATIC TELLER MACHINE

[75] Inventors: Daniel R. Bauer, Hudson, Wis.; Kristofer G. Kosmider, Woodbury, Minn.

[73] Assignee: Diversified Bank Installations, Inc., Hudson, Wis.

[21] Appl. No.: 558,940

[22] Filed: Nov. 13, 1995

Related U.S. Application Data

[63] Continuation of Ser. No. 158,582, Nov. 29, 1993, abandoned.

[51] Int. Cl.[6] ..... G07G 5/00

[52] U.S. Cl. ..... 109/24.1; 109/52; 109/49.5; 40/606; 312/351.5

[58] Field of Search ..... 40/610, 606, 564; 312/351.5, 245; 902/30.31; 202/23.4; 109/24.1, 50–52, 53, 56, 45, 49.5

[56] References Cited

U.S. PATENT DOCUMENTS

| | | | |
|---|---|---|---|
| 1,620,047 | 3/1927 | Van Valkenburg | 312/245 |
| 1,866,135 | 7/1932 | Spiel | 40/564 |
| 2,872,006 | 2/1959 | Payne, Sr. et al. | 312/245 |
| 4,237,636 | 12/1980 | Matthews | 40/606 |
| 4,417,527 | 12/1983 | Williams et al. | 109/53 |
| 4,561,704 | 12/1985 | Smith | 312/223.3 |
| 4,813,475 | 3/1989 | Couvrette | 109/24.1 |
| 5,036,779 | 8/1991 | Capraro | 109/24.1 |

FOREIGN PATENT DOCUMENTS

| | | | |
|---|---|---|---|
| 2239973 | 7/1991 | United Kingdom | 40/564 |

*Primary Examiner*—Barnell M. Boucher

[57] ABSTRACT

An electronic storage cabinet and lighted sign assembly for an ATM comprising a hollow cabinet having a box-like frame with a front surface is attached to the ATM with the frame front abutted against the back portion of the ATM. Special equipment support means are provided within the cabinet for supporting, if desired, a modem and/or alarm means. The modem and alarm means may be easily installed and serviced through side openings which are selectively closed off by side doors. In the preferred embodiment of the invention, a pair of posts are provided as vertical extensions to the cabinet for supporting a lighted sign assembly. Special means are provided for securing the cabinet to the backside of the ATM.

8 Claims, 4 Drawing Sheets

ELECTRONIC STORAGE CABINET AND LIGHTED SIGN ASSEMBLY FOR AN AUTOMATIC TELLER MACHINE

This application is a continuation of application Ser. No. 08/158,582 filed Nov. 29, 1993, now abandoned.

BACKGROUND OF THE INVENTION

Automatic Teller Machines (ATM) are widely used as a convenient way for bank customers to withdraw funds from their accounts and perform other banking functions. ATMs are located at a variety of convenient locations such as shopping malls, supermarkets, gas stations, convenience stores, etc. A number of companies manufacture and/or distribute the basic ATM to the industry. Since ATMs dispense cash in the form of currency, it is necessary to have the ATMs secure from theft. Accordingly, the ATMs are typically fabricated from heavy-duty sheet material (usually heavy gage steel sheeting), and the ATMs typically weigh 700 pounds or more to discourage unauthorized movement or taking away of the ATM.

It is customary to have the ATM connected via telephone lines to a main control point or central processor; this typically requires a modem to facilitate the necessary computer functions and connections. Further, it is customary to have security apparatus on or in the ATM to detect and signal tampering and/or unauthorized movement of the ATM.

Heretofore, the modem and/or alarm means have been stored (i) inside the ATM, (ii) in a special auxiliary equipment cabinet positioned to one side of the ATM, or (iii) separate from the ATM, for example, on or behind a wall of a separate but adjacent structure. It is not desirable to have the modem and/or alarm apparatus within the ATM compartment because installation and servicing of same is not convenient. Further, it is not desirable to have the modem and/or alarm apparatus in a cabinet to the side of the ATM because this requires additional "aisle" or "display" space which, in a retail environment such as a supermarket or shopping center, is a major negative factor. Also, it is disadvantageous to have the modem mounted in an adjacent room or nearby wall because of security access and appearance.

It is also old in the prior art to have display signs mounted directly on the ATM or above the top of the ATM on a pair of spaced apart posts attached to the sides, rear, or back side of the ATM; these arrangements have disadvantages because space is wasted between the posts and/or additional aisle space is used. Also, this arrangement requires that special holes be drilled in the finished top or side ATM surfaces to allow secure post attachment.

SUMMARY OF THE INVENTION

The present invention provides an electronic storage cabinet and lighted sign assembly for an ATM. A hollow cabinet having a box-like frame with a front surface is attached to the ATM with the frame front abutted against the back of the ATM. Within the cabinet are special equipment support means for supporting a modem and/or alarm means. The modem and alarm means may be easily installed and serviced through cabinet side openings which then can be closed off and secured by easily operated side doors. In the preferred embodiment of the invention, a pair of posts are provided as vertical upward extensions to the cabinet for supporting a lighted sign assembly. Special means are provided for securing the cabinet to the backside of the ATM.

Our unique storage cabinet and lighted sign assembly thus becomes integral with the ATM. The weight and bulk of the cabinet and assembly is additive to the weight of the ATM to further deter any unauthorized moving of the ATM or tampering therewith. Further, the cabinet and assembly is, as indicated, connected to the backside of the ATM and, thus, does not require any additional horizontal "aisle" space.

DETAILED DESCRIPTION OF THE PREFERRED EMBODIMENT

Figure 1:
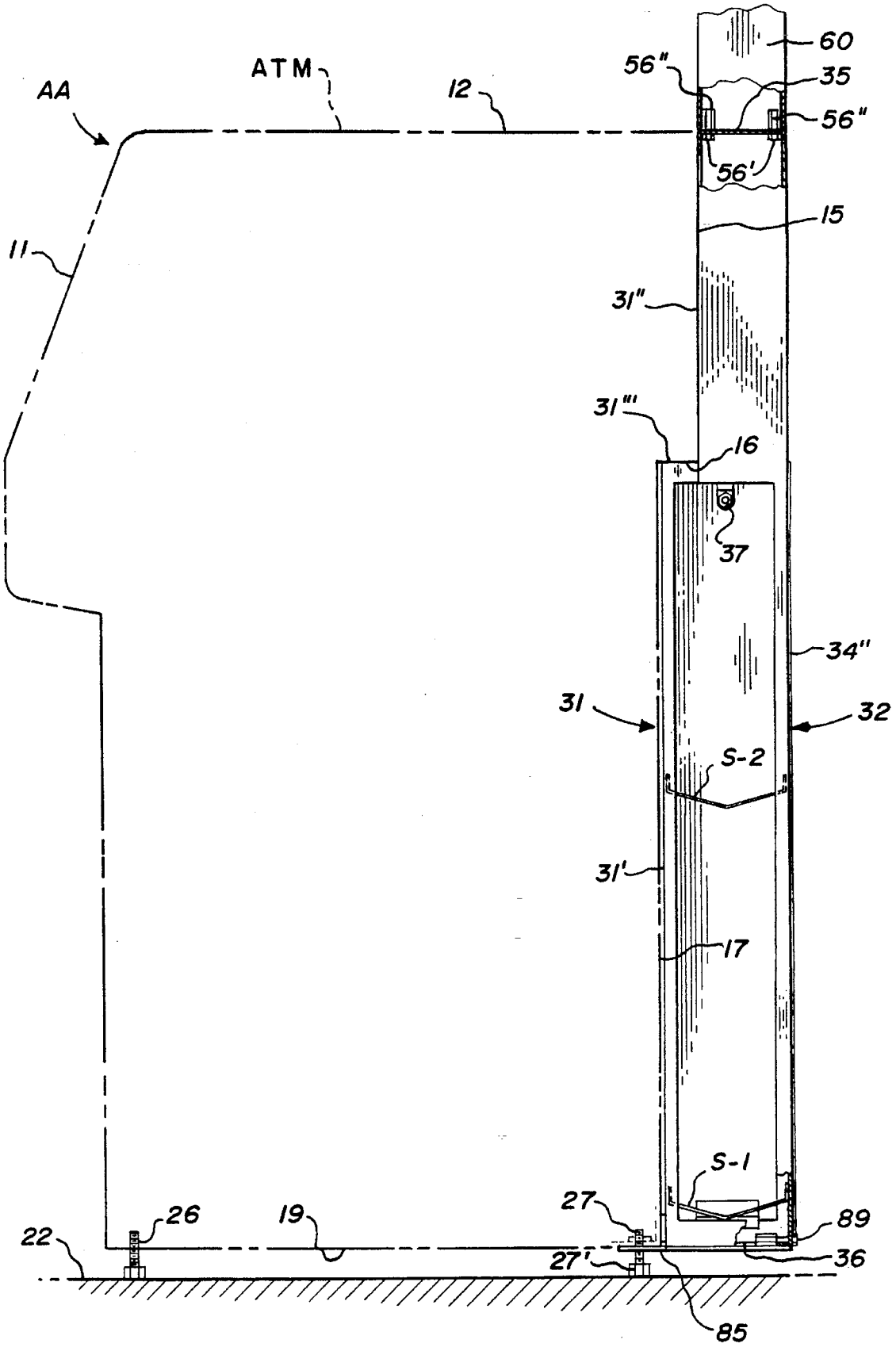
FIG. 1 shows an ATM in phantom from the side and also shows a side view of our cabinet with the right side door removed.

Referring now to FIG. 1, the designator AA is indicative of the "phantom" ATM having a front customer service portion 11, top and bottom portions 12 and 19, and right and left side portions. In FIG. 1, only the right side is presented to the viewer. As depicted the ATM back portion is "stepped" (i.e., a top part 15 and bottom part 17 with a horizontal step 16 joining 15 and 17). As is well known, some ATMs have the stepped back (as shown) while other ATMs have a "flat" back. The ATM is adapted to be placed on a supporting surface 22 such as a concrete floor. Frequently, four supporting and/or leveling legs are placed at the four comers of the bottom of the ATM; two of these are shown in FIG. 1 and are identified by reference numerals 26 and 27.

Figure 2:
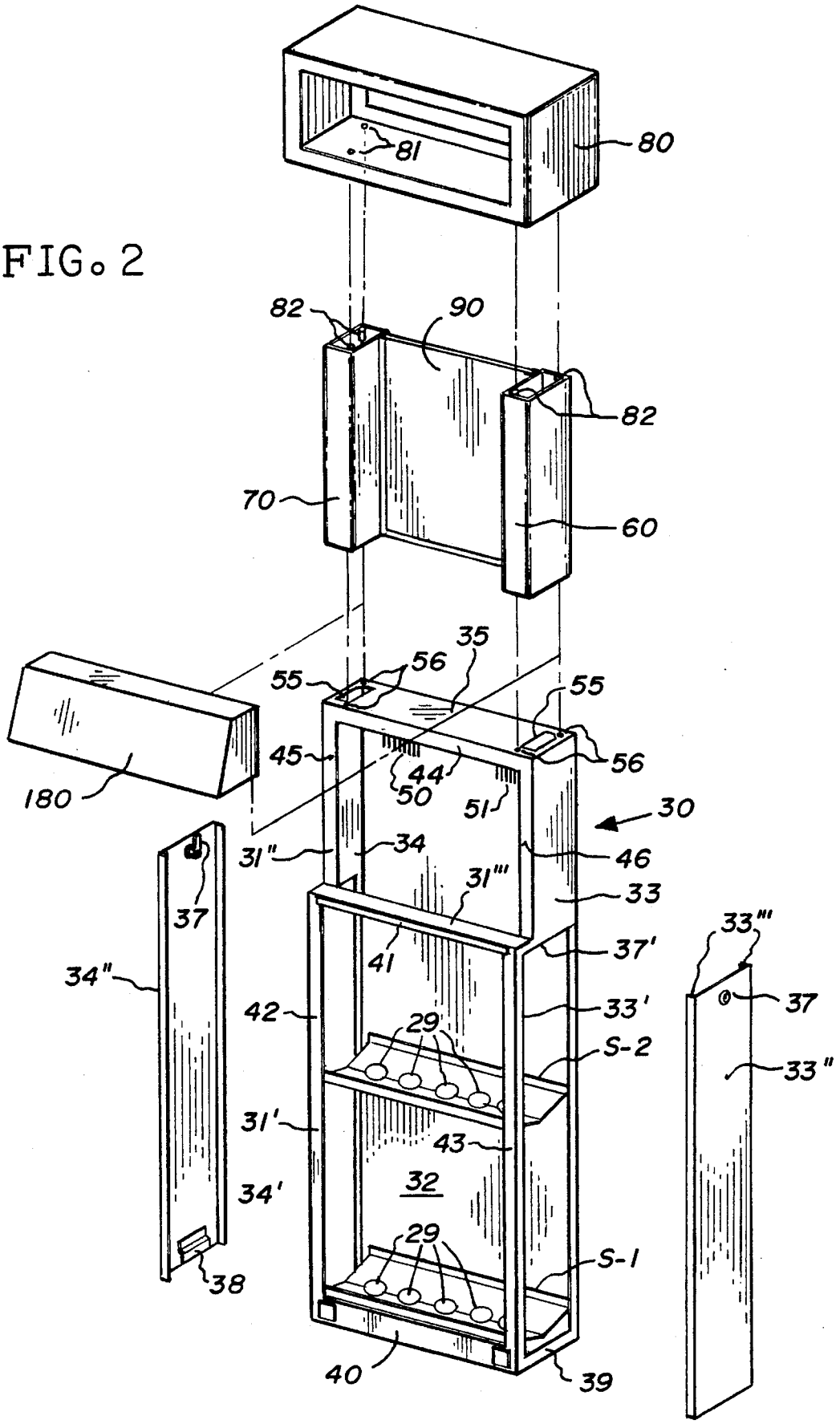
FIG. 2 is an isometric exploded view of our electronic storage cabinet and lighted sign assembly.

The key component of our invention is the electronic storage cabinet shown from the right side in FIG. 1 and in exploded isometric in FIG. 2 and identified by reference numeral 30. As depicted, the cabinet 30 comprises a hollow box-like stand comprising a front 31 (see FIG. 1), a back 32, right and left sides 33 and 34, a top 35, and a bottom 36.

The front 31 is substantially open and has a stepped structure adapted to compliment the stepped back portion of the ATM. More specifically, the front has a lower section 31' and an upper section 31". Section 31' is wider than section 31" and a step 31''' being defined therebetween. Referring to FIG. 1, it is seen how sections 31', 31", and step 31''' compliment ATM portions 17, 15, and step 16 respectively.

Those skilled in the art know that some ATMs have back portions that differ from that shown in FIG. 1. For example, a very frequently encountered ATM is one having a back portion which is flat or planer (i.e., without a step). Accordingly, it should be understood that our invention is not limited to the stand 30 having a step on the front side. In other words, the front 31 of the stand could be essentially planer (i.e., without the step 31''').

In the preferred embodiment of our invention, the stand 30 is fabricated from 0.060 thick steel AISI 1020. The construction preferably is from the steel being bent to form comers and welded at all appropriate joints.

As indicated, the front 31 of the stand is substantially open. However, there is a peripheral frame or edge defined by the openings. More specifically (see FIG. 2), in the lower front section 31' are defined a bottom edge or face 40, a corresponding top edge 41, and two side or vertical edges 42 and 43; portions 40, 41, 42 and 43 in fact are integral with the material at right angles thereto on the right and left sides 33 and 34.

Referring to the upper front portion 31", the peripheral edges are identified by reference numerals 44 for the top and 45 and 46 for the two side or vertical edges.

As indicated, the back 32 of the cabinet is substantially closed off, this being a prerequisite for security of the unit; the only exception is the optional venting slots 50 and 51 which may be provided if required for air flow venting of the unit.

The two sides 33 and 34 of the stand are also of steel and are integral with as by bending and or welding with the front and back 31 and 32 of the stand. Each side has a rectangular shaped opening therein; these are identified by reference numerals 33' and 34', and it will be noted from FIG. 2 that the vertical or longitudinal extent of the openings 33' and 34' is substantially the same as the vertical height or longitudinal extent of the front section 31'.

The cabinet further comprises a first horizontally disposed equipment support means S1 positioned as shown in both FIGS. 1 and 2 to be parallel to and adjacent to the bottom 36 of the stand. The support means S1 is essentially a shelf but has preferably a slight v-shape (see FIG. 1) and also has a plurality of openings (shown as circular holes) to facilitate the passage therethrough of air for ventilating the electronic equipment. The shelves are preferably welded along their lateral edges to the front and back of the cabinet. Shelf S1 may be used to support a modem for electrical linkage of the ATM with a central station or computer or the like.

The cabinet also has a second equipment storage means S2 which is spaced upwardly from the first shelf S1 and is preferably parallel thereto. It also is characterized by having a cross-section in the form of an open "v" with preferably the circular openings 29 for permitting the passage therethrough of ventilating air.

Both shelves S1 and S2 are adjacent to the side openings 33' and 34'. Shelf S2 may be used, for example, to support an alarm (not shown). The modem (not shown) and the alarm (not shown) are not a direct part of this invention but would be used to operate and/or protect ATMs pursuant to the practices of those skilled in the art.

A pair of doors 33" and 34" are provided to be removably attached and detached from the cabinet so as to seal off and lock the openings 33' and 34'. The doors provide convenient access to the modem and/or alarm apparatus storage areas for original installation and also for servicing. Thus, the doors as shown in FIG. 2 are essentially rectangular and elongated. The vertical height or longitudinal extent is sufficient to close off the side openings on a vertical basis. Further, the doors are wide enough and also have longitudinally extending edges at right angles so as to overlap the front and the back of the cabinet (see FIG. 2 wherein the aforesaid right angle edges are identified by reference numeral 33''' for door 33"). Alternately, the doors may be less wide or have a lateral dimension preselected so that the doors fit within the side openings shown in FIG. 2.

Figure 3:
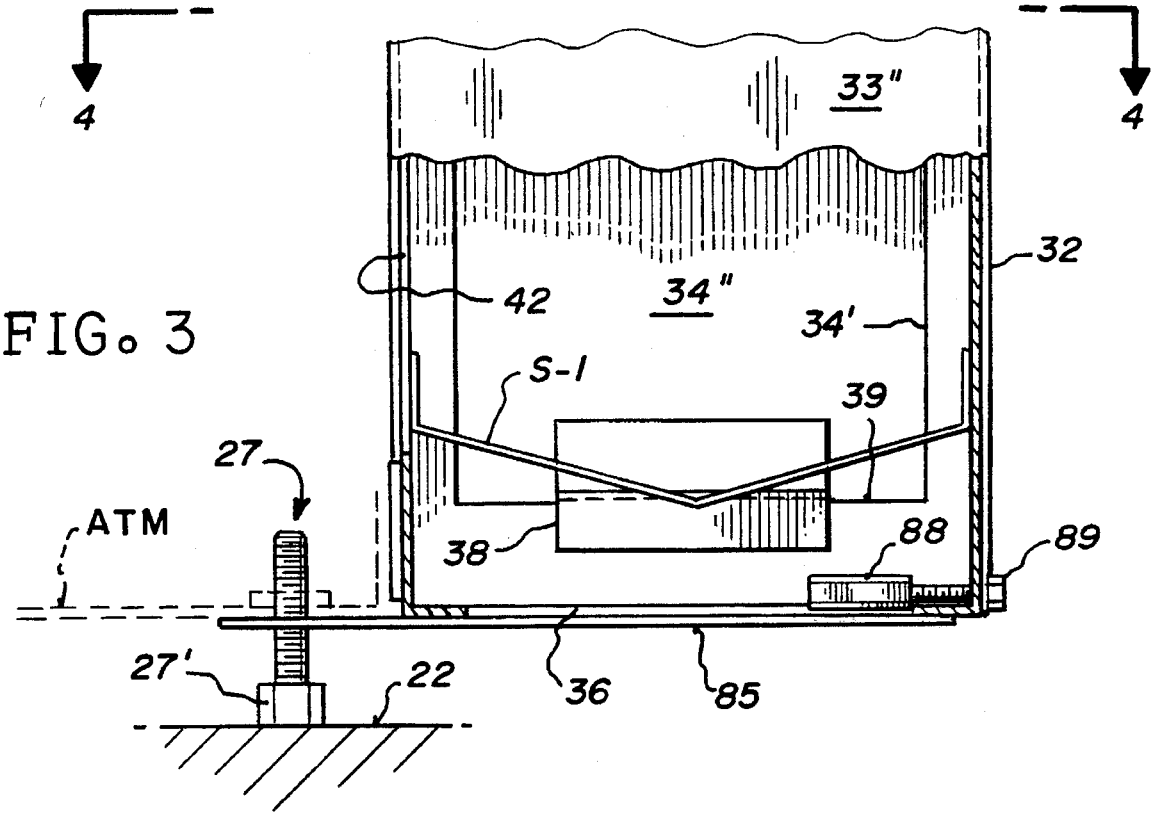
FIG. 3 is an enlarged detail showing of one of the means for attaching the cabinet to the backside of the ATM.

Various means can be used for locking the doors to the cabinet. One arrangement is shown in FIGS. 2 and 3 where a bracket 38 at the bottom of the door on the inside is adapted to hook behind the horizontal section 39 of the sides 33 and 34. At the top or other end of the doors is a key operated lock 37 which, when actuated, would coact with the inside surface 37' of the sides 33 and 34.

It will be understood that the invention is not limited to having two doors, although this is the preferred embodiment. It will be understood that in some applications one of the doors could be eliminated.

In the top 35 of the stand 30, near the sides 33 and 34, are a pair of apertures 55 through which may be extended electrical connections for the display sign. Also adjacent to these openings 55 are a pair of openings 56 for use in attaching and securing a pair of sign posts 60 and 70. In FIG. 1, it is seen that at one end of the sign post 60 are nut-like members 56" attached, as by welding, to the post 60, which are adapted to receive the threaded end of machine screws or bolts 56'.

As depicted in FIG. 2, each of the posts 60 and 70 are hollow with a square or slightly rectangular cross-section having a preselected longitudinal extent so as to provide the desired vertical elevation of the sign box 80 above the surface 22.

The sign box 80 as depicted is generic to a fairly wide variation in sign boxes that are used by the ATM industry. As indicated by the reference numerals 81 and 82, the sign box 80 may be attached to the top ends of the posts 60 and 70 by means which are the equivalent of the means 56' and 56" shown in FIG. 1.

An optional part of the apparatus is a flat sheet 90 or back panel of appropriate material which may be used for advertising purposes or for providing instructions, etc. Back panel 90 is shown to be positioned between the posts 60 and 70 and held in such position by appropriate means such as a channel-like frame.

In some applications it may be preferred to not have the posts 60 and 70; this is suggested in FIG. 2 by having an alternate sign box 180 adapted to be mounted directly on top of the cabinet 30 (i.e., directly on the top surface 35 thereof).

The electronic storage cabinet is adapted to be securely connected to the backside of the ATM. As indicated, above, the configuration of the front of the electronic storage cabinet is designed on a preselected basis to exactly harmonize with the back portion of the ATM.

Figure 4:
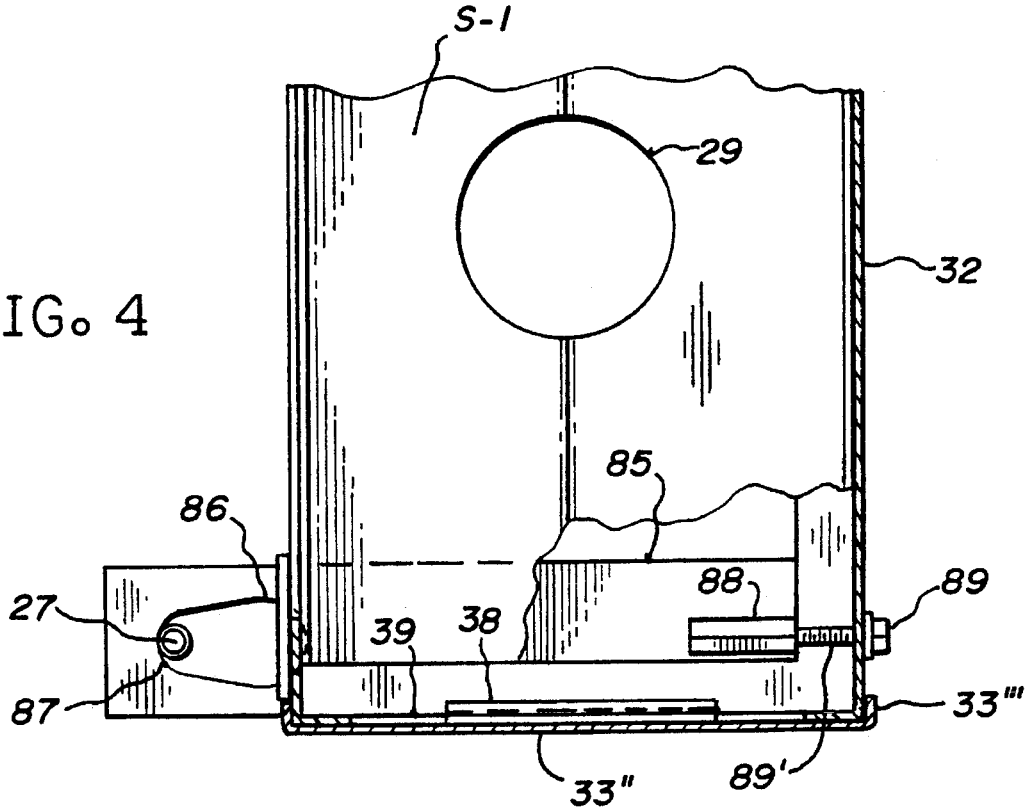
FIG. 4 is a view of the apparatus shown in FIG. 3 as shown along section lines 4—4 thereof.
Figure 5:
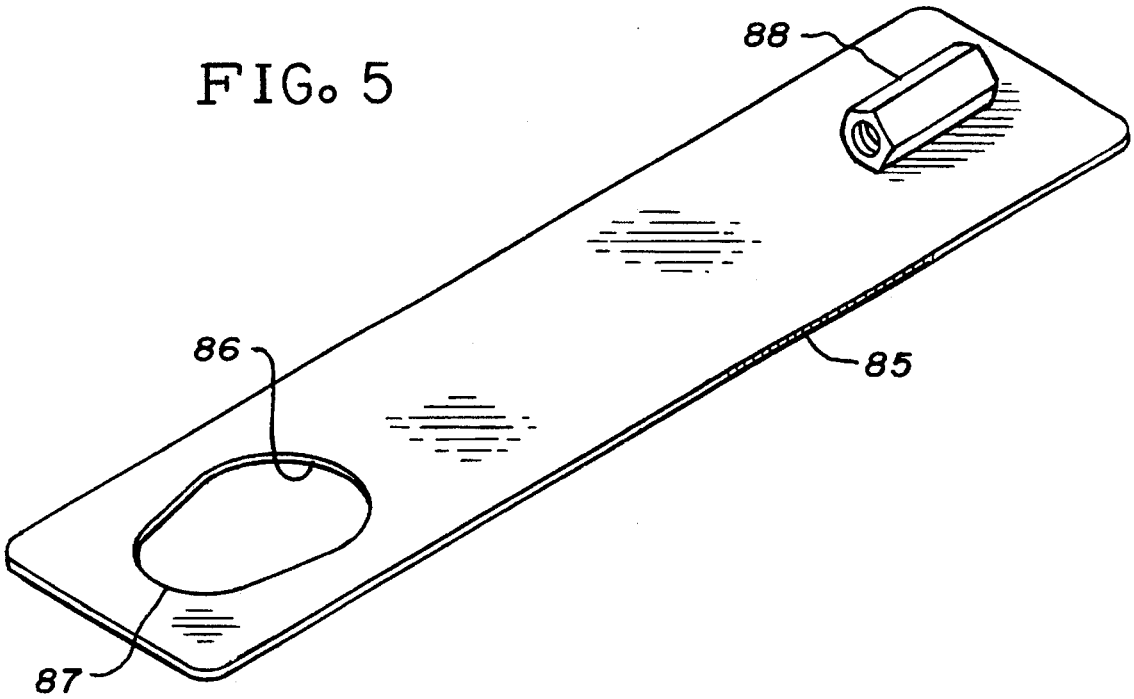
FIG. 5 is an isometric view of the special bracket shown in FIGS. 3 and 4.

In the preferred embodiment of the invention, the bottom portion of the electronic storage cabinet is connected to the bottom portion of the ATM as is best shown in FIGS. 1, 3, 4 and 5. FIG. 5 shows an isometric view of a special bracket 85 having a flat elongated shape with a large diameter aperture 86 in one end thereof, the outboard end of the oblong aperture 86 being identified by reference numeral 87. The aperture 86 is large enough so as to permit the passage therethrough of the bottom part 27' of the leg 27 of the ATM. At the other end of the bracket 85 is a coupler nut 88 bonded as by welding to the bracket and having a threaded bore, the axis of which is aligned with the longitudinal axis of the bracket 85.

The bracket 85 is used as follows: The bracket aperture 86 is passed over the foot portion 27' of the leveling leg 27 of the ATM as is depicted in FIGS. 1, 3 and 4. The main body of the bracket 85 is abutted against the bottom 36 of the stand. A bolt 89 passes through a suitable hole in the back 32 of the stand; the threaded portion 89' of the bolt is screwed into the nut 88, and the bolt 89 is rotated a sufficient amount so that the end 87 of the aperture 86 in the bracket 85 is snugly abutting the threaded portion of the leveling foot 27 of the ATM. As will be understood, this permits a very firm and strong connection at both of the lower front comers of the stand to the ATM. It will be further understood that the bolts 89 can be locked in place to avoid unauthorized access or tampering by using an appropriate means (not shown), either external of the back 32 or internal of the back 32 such as by having access through the doors 33" an 34".

Additional means may be used to firmly attach the cabinet to the ATM. For example, machine screws may extend through appropriate apertures in horizontally positioned members 40 and/or 44 and into cooperative apertures in the ATM. Thus, the cabinet would be attached to the ATM at the bottom as above described and also at the top and/or intermediate or middle locations to have the cabinet and ATM become an integral assembly.

We claim:

1. An electronic storage cabinet and lighted sign assembly for an automatic teller machine (ATM), said ATM having a front customer service portion and top, back, bottom, and right and left side portions, said cabinet and sign assembly comprising:

(a) a cabinet comprising:

a hollow box-like stand having a front, a back, right and left sides, a top and a bottom, said front being substantially open, said back being closed, said right and left sides being dosed except for rectangular shaped openings therein, and said top including means for receiving and holding sign posts;

a first horizontally disposed equipment support means within said cabinet, and adjacent to said bottom of said stand as well as to said side openings;

a second equipment support means within said cabinet spaced from said first support and adjacent to said side openings;

right and left side door members adapted to be removably connected to said right and left sides of said stand so as to close off said side openings;

(b) a pair of elongated posts, each attached at one end thereof to opposite ends of said top surface of said stand and extending in spaced apart parallel relationship upwardly away from said top of said stand;

(c) a sign box connected to the other ends of said posts; and (d) means for attaching said cabinet to an ATM whereby said front of said stand is abutted against and secured to a back portion of said ATM.

2. An electronic storage cabinet for abutment against and attachment to the back portion of an automatic teller machine (ATM), said ATM having a front customer service portion and a top, back, bottom and right and left side portions, and a support leg, said cabinet comprising:

(a) a hollow box-like stand having a front, a back, right and left sides, a top and a bottom, said front being substantially open, said back being closed, and said right and left sides being closed except for at least one of said sides having an opening therein;

(b) a first horizontally disposed equipment support means positioned within and secured to said cabinet, and adjacent to at least one said side opening;

(c) a side door removably connected to said side of said stand so as to close off at least one said side opening; and (d) means for attaching said cabinet to an ATM whereby said substantially open front of said stand is abutted against and secured to a back portion of said ATM, said attachment means including bracket means linking said cabinet to an ATM support leg, said bracket means being adjustably connected at said back of said stand.

3. Apparatus of claim 2 further characterized by said cabinet including a second horizontally disposed equipment support means positioned within and secured to said cabinet.

4. Apparatus of claim 3 further characterized by said first and second equipment support means being positioned within said cabinet so that one end thereof is adjacent to said opening in the at least one side.

5. Apparatus of claim 4 further characterized by said first and second equipment support means being formed from sheet metal and having laterally disposed air ventilating apertures.

6. Apparatus of claim 5 further characterized by said first and second equipment support means having a "v" shaped vertical cross-section.

7. Apparatus of claim 2 further characterized by said top of said stand including means for receiving and holding sign posts; a pair of elongated posts of preselected length connected at one end thereof to said receiving and holding means of said top of said stand; and extending in spaced apart parallel relationship upwardly away from said top of said stand; and a sign box connected to the other ends of said posts.

8. Apparatus of claim 2 further characterized by said top of said stand including means for receiving and holding a sign box and a sign box connected thereto.

* * * * *